US006445803B1

(12) United States Patent
Boon et al.

(10) Patent No.: US 6,445,803 B1
(45) Date of Patent: Sep. 3, 2002

(54) SPEAKER

(76) Inventors: Chuan How Boon, 168 Browns Rd, Manurewa, Auckland 1702 (NZ); Jason Noe Kia-Chong Boon, 168 Browns Rd, Manurewa, Auckland 1702 (NZ)

( * ) Notice: Subject to any disclaimer, the term of this patent is extended or adjusted under 35 U.S.C. 154(b) by 0 days.

(21) Appl. No.: 09/722,430

(22) Filed: Nov. 28, 2000

(30) Foreign Application Priority Data

Dec. 16, 1999 (NZ) ..... 501796
Sep. 14, 2000 (MY) ..... PI 20003841

(51) Int. Cl.[7] ..... H04R 25/00

(52) U.S. Cl. ..... 381/184; 381/423; 381/424; 381/432

(58) Field of Search ..... 381/182, 184, 381/186, 423, 424, 425, 432, FOR 162, 405; 181/157, 161, 163, 164, 165, 171, 172

(56) References Cited

U.S. PATENT DOCUMENTS 2,231,479 A * 2/1941 Perry ..... 381/424
4,477,699 A * 10/1984 Wada et al. ..... 381/423
5,933,512 A * 8/1999 Tamura ..... 381/424

* cited by examiner

*Primary Examiner*—Huyen Le
(74) *Attorney, Agent, or Firm*—Jacobson Holman, PLLC

(57) ABSTRACT

The present invention relates to an improved speaker which includes at least one radiating surface configured to vibrate to produce sound waves, and an existing speaker cone configured to vibrate to produce sound waves, wherein said at least one radiating surface is adapted to fit over or onto the existing speaker cone, the said at least one radiating surface having a direct or indirect airtight attachment to the existing speaker cone to provide a hermetically sealed cavity between the existing speaker cone and said at least one radiating surface.

3 Claims, 2 Drawing Sheets

SPEAKER

TECHNICAL FIELD

This invention relates to improvements to speakers used with electronic audio systems. Preferably the present invention may be adapted to improve the performance of existing speakers used to produce music, sound effects or dialogue in commercial or domestic sound systems.

BACKGROUND ART

This invention relates to improvements to or associated with speakers used with electronic audio systems. Preferably the present invention may be adapted to improve the performance of existing speakers used to produce music, sound effects or dialogue in commercial or domestic sound systems.

BACKGROUND ART

Electronically driven sound speakers are used in a wide variety of applications and locations. Speakers can be provided as part of a domestic home entertainment system or as part of the sound systems for movie theatres, bars, clubs or any other business with the need to transmit sound into an area.

In the case of systems primarily used to produce music, some listeners have very high standards for the quality of sound produced. The design of speakers used in such systems will have a significant effect on the quality of the resulting sound.

A standard electrical loud speaker normally employs a single flexible cone or diaphragm. This cone is mounted to the speaker housing through a single flexible connector or suspension system. The cone is linked to an electromagnetic driving system to vibrate the cone at the frequencies required to produce music or other sounds. Usually an analogue electrical signal is provided to drive the speaker, with the electrical properties of this signal determining the frequencies and the amplitude of the sounds produced by the speaker cone.

One problem with this type of speaker design is the presence of noise signals on the same line as the speaker-driving signal. These noise signals will also be reproduced as part of the sound produced by the speakers. Electrical noise can be caused for example, by low quality cabling used between the speaker and an audio amplifier, or through loose or bad connections between the speaker and the amplifier. In these instances relatively high frequency noise will be transmitted into the speaker and reproduced as unwanted sound.

Existing speakers can also experience problems when required to produce high volume low frequency bass sounds. The frequency and the amplitudes of the signals involved may cause a speaker housing or casing to resonate, thereby distorting the sound produced by the speaker and reducing the overall quality of the sound produced.

These speaker designs are also limited in the range of sound frequencies they can produce. Some speakers have difficulty producing low frequency or bass sounds because of the inability of the speaker cone to vibrate at the correct frequency. In this regard the mounting system for the speaker cone, the size of the speaker cone and also the materials used in its construction all have a significant effect on the ability of the speaker to produce such low frequency sounds.

Furthermore, these types of speakers may also experience degradation in the quality of the sound produced when low volumes are required. As the energy transmitted through to the speaker cone is relatively low, the physical resistance of the cone to vibration, and also the mounting system used to attach the cone to the housing may damp down the amount of energy retransmitted on as sound waves. This can be the cause of significant power losses at low volumes and hence result in a corresponding decrease in the quality of the sound produced.

An improved speaker or an attachment for a speaker that solved any or all of the above problems would be of advantage. Specifically an improved speaker system that could damp out or remove problems associated with high frequency noise sources, which could reduce or eliminate the chances of speaker casing resonating with low frequency bass sounds, which improved with the ability of the speaker to produce low frequency sounds and which also performed well at low listening volume levels would be of advantage.

It is an object of the present invention to address the foregoing problems or at least to provide the public with a useful choice.

Further aspects and advantages of the present invention will become apparent from the ensuing description that is given by way of example only.

SUMMARY OF THE INVENTION.

According to one aspect of the present invention there is provided an improved speaker which includes:

at least one radiating surface configured to vibrate to produce sound waves, and an existing speaker cone configured to vibrate to produce sound waves, wherein said and at least one radiating surface is adapted to fit over or onto the existing speaker cone, the said at least one radiating surface having a direct or indirect airtight attachment to the existing speaker cone to provide a hermetically sealed cavity between the existing speaker cone and said at least one radiating surface. According to another aspect of the present invention there is provided an improved speaker which includes:

at least two radiating surfaces, and a housing adapted to at least partially enclose and support said at least two radiating surfaces, and a primary flexible suspension element adapted to directly secure a radiating surface to said housing, and at least one secondary flexible suspension element adapted to indirectly secure one or more radiating surfaces to said housing.

According to yet another aspect of the present invention there is provided a speaker modifying module and speaker which includes:

at least one radiating surface configured to vibrate to produce sound waves, said at least one radiating surface being adapted for airtight attachment to an existing speaker to form a hermetically sealed cavity between the topside diaphragm or cone of said existing speaker and said at least one radiating surface.

According to a further aspect of the present invention there is provided a speaker modifying module which includes:

at least two radiating surfaces, and a housing adapted to at least partially enclose and support said at least two radiating surfaces, and a primary flexible suspension element adapted to directly secure a radiating surface to said housing, and at least one secondary flexible suspension element adapted to indirectly secure one or more radiating surfaces to said housing, said module being adapted for airtight attachment to an existing speaker to form a hermetically sealed cavity between the topside diaphragm or cone of said existing speaker and the speaker-modifying module.

The present invention may be adapted to provide improvements to existing speaker technology. The present invention may be used either in the construction of new speakers as an integral component or alternatively may be or provided as an improvement module or component which can be installed into or onto an existing speaker. Reference throughout this specification will also be made to the present invention being implemented as an after market module or kit used to improve the performance of an existing speaker. However, it should be appreciated by those skilled in the art that other applications have also been considered and reference to the above only throughout this specification should in no way be seen as limiting.

In a preferred embodiment the present invention may be adapted to fit over or onto an existing single radiating speaker cone mounted in a standard speaker. This existing speaker cone may be driven normally by an electromagnetic driving system and may radiate and direct the appropriate frequency sound waves up onto the rear surfaces of the radiating surface or surfaces cones discussed above.

At least one radiating surface may be adapted to fit over the top of such an existing speaker cone with an airtight attachment. This will provide a substantially sealed cavity between the driven speaker cone and the one or more radiating surfaces of the present invention. This will allow air pressure waves generated by the driven speaker cone to drive the radiating surface or surfaces of the present invention. In such an embodiment there is no need to provide a separate driving element for the radiating surface or surfaces provided and discussed above. The substantially sealed cavity formed with the driven speaker cone can harness a "pump" effect to simply re-transmit and re-create sound waves created by the driven speaker cone.

The present invention may employ at least one radiating surface which is configured to vibrate to produce sound waves. A radiating surface may be defined as any element or component that is adapted to vibrate and produce sound waves. Those skilled in the art should appreciate that all manner and types of materials may be used in the construction of such radiating surfaces to provide speaker cones or diaphragms in the construction of the present invention. For example, a radiating surface may be constructed from paper or cardboard, plastic materials, carbon fibre materials, kevlar or any other suitable material.

The main aim of the present invention is to provide a substantially sealed cavity between a driven speaker cone and a new radiating surface provided through the construction of the present invention. Numerous designs and different embodiments of the invention may also be constructed to embody this concept by using one, two or even more radiating surfaces to trap a pocket of air in the vicinity of a driven speaker cone. For example, in one embodiment a single speaker cone only may be provided above a driven speaker cone and may be attached either directly or indirectly to the driven speaker cone to provide a substantially sealed cavity between both elements. As will be appreciated by those skilled in the art an additional radiating surface may be either directly connected to a driven speaker cone or may be indirectly connected to the driven speaker cone through use of a housing or spacer elements.

Reference however throughout this specification will however be made to the present invention employing at least two radiating surfaces which are mounted above or near a driven speaker cone to provide a hermetically sealed cavity between the cone and the additional radiating surfaces provided. However, those skilled in the art should appreciate that other configurations of the present invention are envisioned using for example a single additional radiating surface only and reference to the above only throughout this specification should in no way be seen as limiting.

In a preferred embodiment the present invention may be provided with a housing to at least partially enclose and support the plurality of radiating surfaces used. The housing can be adapted to fix in place each of the radiating surfaces, and allow a surface to vibrate to produce sound waves.

In a preferred embodiment the present invention may include a first or primary flexible suspension element which is adapted to directly secure a radiating surface to the housing. Such a primary flexible suspension element may be similar to existing systems already used in prior art speakers to fix a cone or diaphragm in place with respect to its housing. Such suspension elements are adapted to hold a diaphragm in place yet still allow the cone to vibrate to produce the appropriate frequency sound waves. The primary suspension element used in this instance may be any element with a substantially flexible nature that will still allow the edges of the radiating surface to vibrate while connecting these edges directly onto the housing.

Those skilled in the art should appreciate that any type of appropriate material can be used to construct or form a flexible suspension element used in accordance with the present invention. For example, a flexible suspension element may be constructed from synthetic foams, rubbers, textile products or any other material that can function effectively to suspend a radiating surface from the housing.

In a preferred embodiment the present invention may include at least one secondary flexible suspension element adapted to indirectly secure one or more of the radiating surfaces to the housing. A secondary flexible suspension element may be constructed from substantially the same materials and in substantially the same way as the primary flexible suspension element. However, a secondary suspension element may be adapted to indirectly connect a radiating surface to the housing by connecting the radiating surface to an edge or topside diaphragm or cone of another radiating surface, which is in turn indirectly or directly connected to the housing.

In a further preferred embodiment each of the radiating surfaces may be shaped as substantially conical or circular curved surfaces. Each radiating surface may have a different diameter or radius of curvature to the other surfaces to allow the surfaces to be nested together as a series of concentric cones or rings. In such an embodiment the primary flexible suspension element may be used to link or attach the largest radiating surface cone or ring to the housing. A secondary flexible suspension element may then be used to attach another smaller diameter radiating surface to the first radiating surface directly attached to the housing. Further secondary flexible suspension elements and reduced diameter radiating surfaces may also be indirectly attached to the housing to provide a series of concentric radiating surface rings or cones.

This configuration of the invention is adapted to reduce actual length, width or diameter of each radiating surface incorporating into the invention, while still preserving the ability of each radiating surface to vibrate or flex freely to produce the appropriate frequency sound waves. By reducing the width or diameter of each radiating surface the acoustic performance and qualities of the resulting speaker is improved substantially. The improvements provided are also discussed in detail further below.

In a preferred embodiment the present invention may include two radiating surfaces only. As discussed above these radiating surfaces may be shaped as circular cones or discs with a first of these surfaces being attached directly to the housing. The second of these surfaces may be placed inside the inner perimeter of the first surface and attached indirectly to the housing through use of a secondary flexible suspension element and the first radiating surface.

Reference throughout the specification will also be made to the present invention employing the arrangement of two radiating surfaces discussed above. However, it should be appreciated by those skilled in the art that other arrangements and configurations of the radiating surfaces and the suspension elements are also considered, and reference to the above only throughout this specification should in no way be seen as limiting. For example, in one alternative embodiment the present invention may employ three radiating surfaces nested together as a concentric array of rings.

In a further preferred embodiment the present invention may also include a central spacing or supporting element fixed to the inner perimeter of the smallest radiating surface. Preferably this spacing element may be shaped as a substantially cylindrical body and may extend down on to and be connected directly to the centre of the driven speaker cone when the invention is mounted on a standard speaker. This supporting element may also transmit vibrational energy from the driven speaker cone up into the inner radiating surface of the present invention.

This configuration of the invention provides an additional pathway for energy present on the driven speaker cone to be transmitted directly to the smallest radiating surface. The use of such a spacing element in combination with the substantially sealed cavity between the invention's two radiating surfaces and a driven speaker cone provides high efficiency transfer of the vibration energy of the driven speaker cone up to the two radiating surfaces of the present invention.

The primary and secondary flexible suspension elements discussed above coupled with the reduced diameter or width of each of the radiating surfaces provides substantial improvements to the performance of the resulting speaker. As each of the radiating surfaces are allowed to vibrate relatively freely this results in an improved power transmission of sound at low listening volume levels. As the width of each radiating surface is relatively small compared with existing prior art speaker cones, and each of these radiating surfaces are relatively free to move due to the primary and secondary suspension elements, there is less excitation energy lost or damped out of the system by the arrangement and configuration of the speaker. More energy than normal is reproduced as sound waves and hence will provide improved quality sound reproduction at relatively low listening volumes.

Furthermore, the above arrangement of radiating surface cones and suspension elements may also substantially improve the frequency response of a resulting speaker. Because of the greater flexibility and freedom of movement provided to each radiating surface, each radiating surface will be better able to produce very low frequency bass sounds that cannot normally be produced with quality by a standard or driven speaker cone.

The arrangement and connection of the at least one radiating surface onto the face or on top of a driven speaker cone also provides some additional noise dampening or filtering advantages. The substantially sealed cavity between the driven speaker cone and the radiating surface or surfaces acts to damp out distortion caused by a speaker cabinet resonating in a particular low sound frequency. This configuration also provides the ability to damp out high frequency noise caused by electronic noise on a driving signal supplied to the speaker.

The present invention provides many potential advantages over existing prior art speakers.

In a further preferred embodiment where a new speaker assembly is constructed including the present invention, the initial standard speaker cone located underneath at least one radiating surface may be constructed from relatively lightweight thermal conductor such as aluminium. Aluminium and other metals are not normally used in existing speakers because they tend to make the resulting sound waves produced sound metallic in origin. However, if at least one radiating surface of the present invention is provided above such a metallic speaker cone, the hermetically sealed cavity between these elements can be used to damp out or filter the metallic overtones of the sounds produced. Furthermore, constructing the existing or first speaker cone from a thermal conductor allows it to be used as a relatively large heat sink or cooling element for the speaker. This first speaker cone can be used by the speaker to radiate heat energy out from the driving electronics used to power the speaker.

The present invention provides many potential advantages over existing prior art speakers.

The present invention may be configured as an after market module to modify an existing speaker or alternatively may be constructed into or formed as part of a new speaker.

The present invention may be adapted to improve the low frequency response of loud speakers allowing them to produce lower frequency and high quality sound.

The present invention may also be used to damp out or filter bass distortion or high frequency noise commonly produced by existing speakers.

The present invention may also be adapted to provide high quality sound at relatively low listening volumes due to improved power transmission through the invention's radiating surfaces.

For the present invention to provide high quality low frequency sound the radiating surfaces have to be linear and stable during operation. The suspensions used play a very important part in the operation of the invention. Low frequency sound requires long cone throws, which in turn require a soft suspension system to facilitate the movements needed. Too soft a suspension system will create instability in the radiating surfaces as well as low power transmission to sound energy, while too stiff a suspension system will reduce the emitted power of low frequency sound.

Preferably the present invention uses the 'trapped' air between radiating surfaces, the driven speaker cone, the housing adaptor and the flexible suspension elements to provide a speaker system that is acoustically tuned to provide an extremely high efficiency low frequency response.

Disclose the invention, as claimed, in such terms that the technical problem (even if not expressly stated as such) and its solution can be understood, and state the advantageous effects, if any, of the invention with reference to the background art.

BRIEF DESCRIPTION OF DRAWINGS

Further aspects of the present invention will become apparent from the ensuing description that is given by way of example only and with reference to the accompanying drawings in which:

FIGS. 1*a*, 1*b* show a speaker configured in accordance with one embodiment of the present invention. In the embodiment shown, the present invention is configured as a speaker modifying module 1 adapted to fit over the top of a driven speaker 2. FIG. 1*b* shows clearly in solid lines the elements of the modifying module 1 and in dotted lines the elements of the driven speaker cone 2 and a voice coil 13.

DESCRIPTION OF THE INVENTION

Figure 1A:
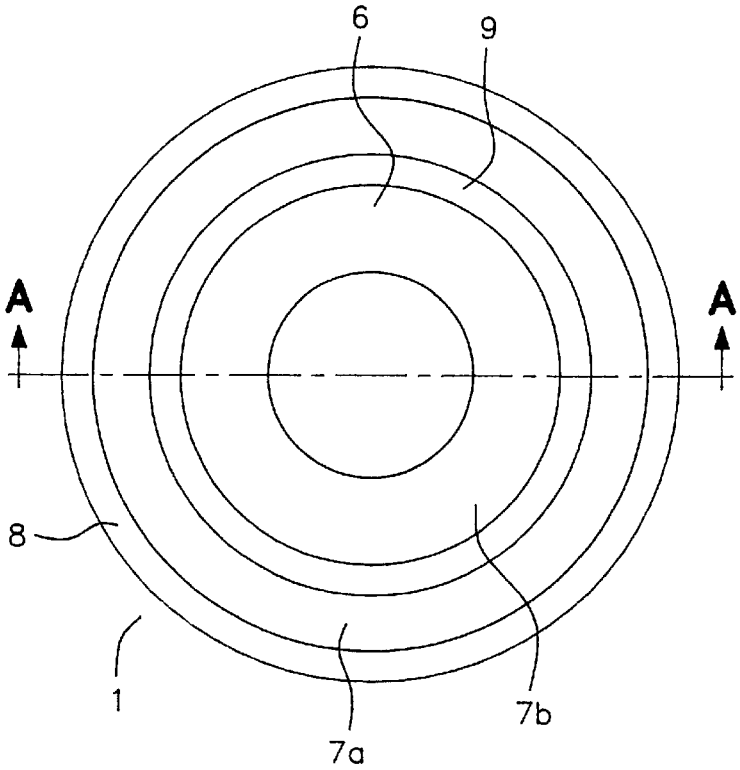
FIG. 1*a* shows a top view of a speaker configured in accordance with one embodiment of the present invention.
Figure 1B:
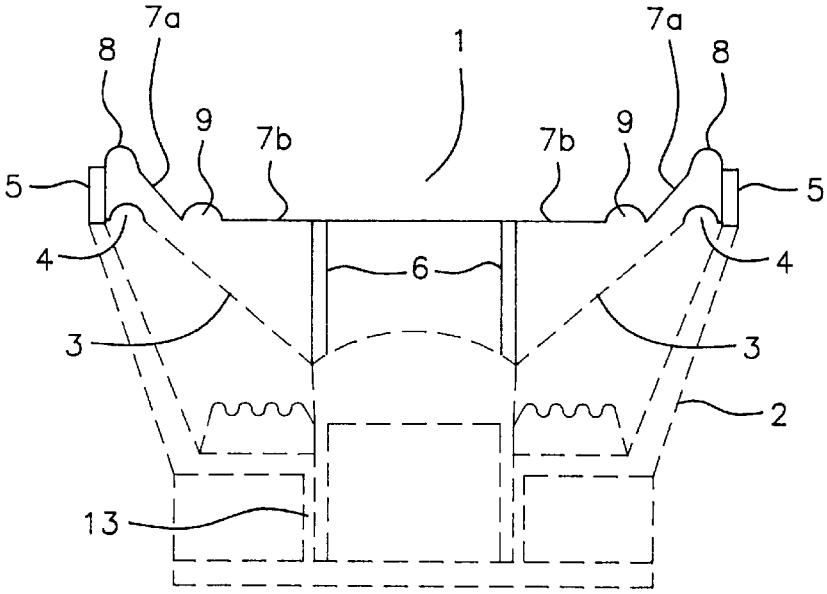

FIGS. 1*a*, 1*b* show a speaker configured in accordance with one embodiment of the present invention. In the embodiment shown, the present invention is configured as a speaker modifying module 1 adapted to fit over the top of a driven speaker 2. FIG. 1*b* shows clearly in solid lines the elements of the modifying module 1 and in dotted lines the elements of the driven speaker 2.

The driven speaker cone includes an diaphragm 3 mounted on the main body of the speaker 2 by a single flexible suspension element 4.

The module 1 has been attached to the top of the driven speaker 2, through use of a module housing formed in the embodiment shown as a spacer gasket 5. The gasket 5 is adapted to partially enclose and retain in place other portions of the module 1.

The module 1 also includes a hollow and cylindrical centre column 6 that is adapted to support the underside and centre of the module 1. This column may act as a spacing element to support the underside of the module and also to provide an additional pathway for energy to be transmitted from the top portion 3 of the driver speaker cone up to the module. Vibrations in the top portions cone 3 may be transmitted through the cylindrical central column 6 up unto the underside and centre of the module 1.

The speaker cone (3) is driven by a cylindrical voice coil (13) connected to its rear face, and the diameter of the cylindrical supporting element (6) is the same as the diameter of the voice coil (13)

The module 1 also includes first and second radiating surfaces 7*a*, 7*b*. The first of these radiating surfaces 7*a* is directly attached or connected to the spacer gasket 5 by a primary flexible suspension element 8. The primary suspension element 8 is used to connect both of the radiating surfaces 7*a*, 7*b* to the gasket 5 while still allowing these radiating surfaces to vibrate effectively to produce sound waves.

The module 1 also includes a secondary flexible suspension element 9 which is adapted to indirectly secure the second radiating surface 7*b* to the gasket 5. This indirect connection is achieved by the secondary suspension element directly linking to the second radiating surface 7*b* to the inside perimeter of the first radiating surface 7*a*. As the first radiating surface 7*a* is directly linked to the gasket 5, this provides an indirect connection for the second radiating surface 7*b* to the gasket 5.

The gasket 5 is also adapted to provide a substantially sealed connection between the module 1 and the driven speaker 2. This connection will form a substantially sealed cavity between the speaker cone top portions 3 of the driven speaker cone and the radiating surfaces 7*a*, 7*b* of the module 1. By providing such substantially sealed cavity any sound energy generated by the top portions 3 will be directed upwards and on to the bottom of each of the radiating surfaces 7*a*, 7*b*. This will in turn induce a vibrational motion into each of the radiating surfaces 7*a*, 7*b* and hence force the surfaces to vibrate at the same frequency which the existing top portions 3 is also vibrating.

Furthermore, the direct linkage provided by the column 6 between the top portions 3 and the smaller of the radiating surfaces 7*b* provides an additional pathway for vibrational energy to be transmitted through to the module 1. Vibrations present on the top portions 3 can be transmitted directly up the spacing column 6 onto the inner perimeter of the smaller of the radiating surfaces 7*b*.

This configuration of the invention means that no additional driving circuitry is also required to operate and vibrate each of the radiating surfaces 7*a*, 7*b*. By providing a substantially sealed connection between these elements the sound waves generated by the driven speaker cone 2 can be used to hydraulically "pump" the upper radiating surfaces 7*a*, 7*b*.

Furthermore, the cavity formed also has a significant damping effect on unwanted noise frequencies produced by the driven speaker. The arrangement and construction of the module 1 is such that it will act to damp out or reduce the power of high frequency noise generated by the driven speaker cone and reduces the chances of the driven speaker cone 2 resonating its housing at relatively low sound frequencies.

The configuration of the two radiating surfaces 7*a*, 7*b* with the primary and secondary suspension elements provides a high degree of freedom of movement to each of the radiating surfaces 7*a*, 7*b*. This in turn allows each of the surfaces to vibrate easily at relatively low frequencies and also at relatively low power input levels. This will result in the module 1 improving the ability for the speaker to produce low frequency sound waves and also improving the sound quality of the speaker at low volume listening levels.

Figure 2:
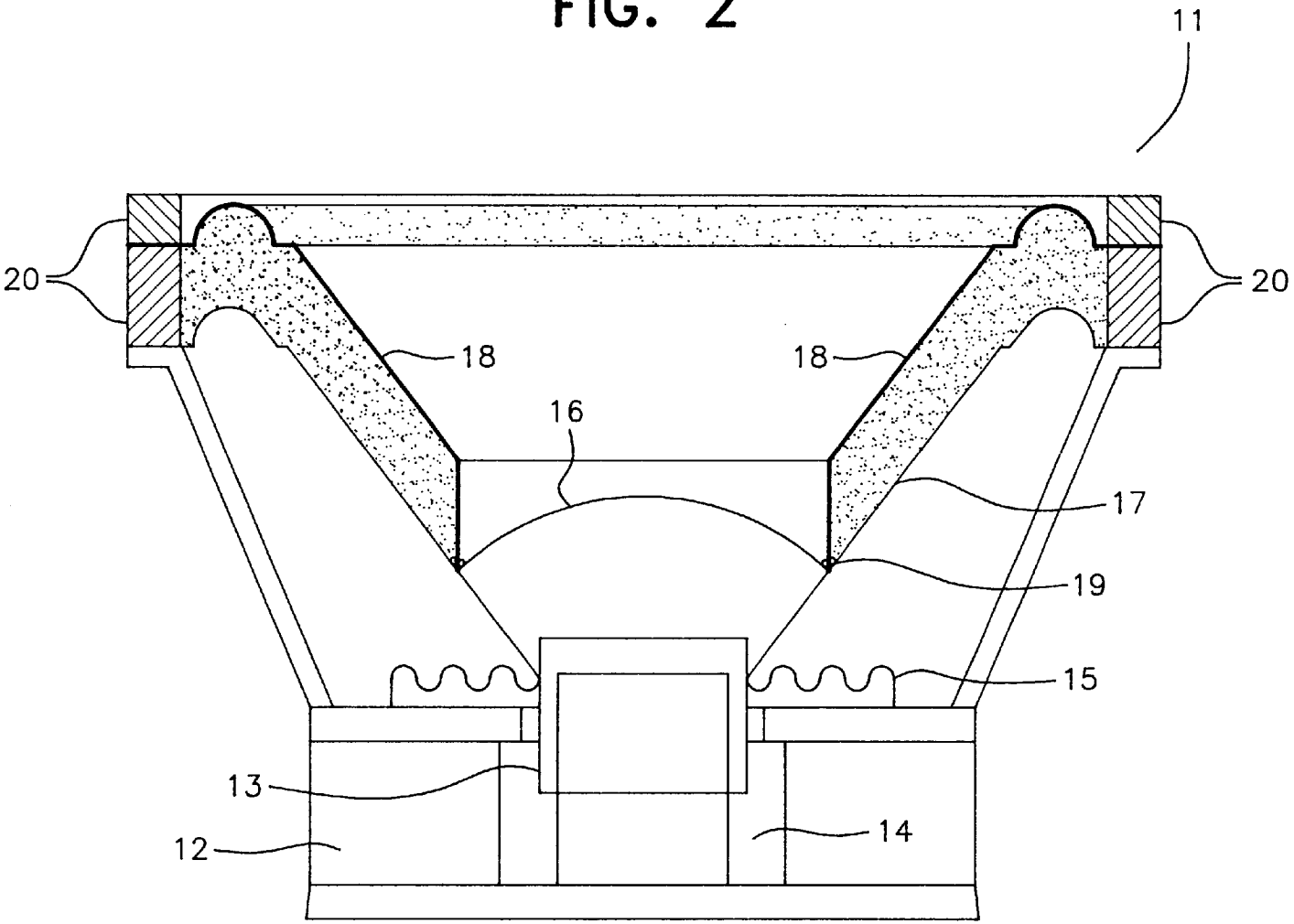

FIG. 2 shows a cross section side view of a speaker as configured in accordance with an alternative embodiment to that shown with respect to FIGS. 1*a*, 1*b*.

In the embodiment shown the improved speaker includes a number of components from an existing known type of speaker. For example, the improved speaker 11 includes a driving magnet 12, voice coil 13, central pole piece 14, damper elements 15, dust cap 16, and a driven speaker cone 17 which is to be driven to vibrate to produce sound waves.

To provide the improvement given through the present inventional single radiating surface 18 is located directly above the existing cone 17. The radiating surface 18 is joined at one end 19 directly to the existing cone 17 and at opposite end to set of spacing gaskets 20 which form a top housing for the additional components added on to the existing speakers.

The connections and attachments of the radiating surface are such that a substantially sealed cavity is provided between the radiating surface 18 and the existing cone 17, allowing air trapped within this cavity which is excited by the driven speaker cone to move up against the radiating surface 18 and to drive same to produce sound waves.

Aspects of the present invention have been described by way of example only and it should be appreciated that modifications and additions may be made thereto without departing from the scope thereof as defined in the appended claims.

What we claim is:

1. A speaker comprising:

a driven speaker cone, at least two radiating surfaces configured to vibrate to produce sound waves, a housing adapter supporting said at least two radiating surfaces, a first flexible suspension element adapted to directly secure a first said radiating surface to said housing adapter, a secondary flexible suspension element adapted to secure a second said radiating surface to said first radiating surface, and a support element connecting said second radiating surface to said driven speaker cone, said cone, said radiating surfaces, said housing adapter and said suspension elements enclose a sealed cavity, said first radiating surface surrounds said second radiating surface and said first suspension element is annular and directly securing and connecting said first radiating surface and said housing adapter, and said second suspension element is annular and being connected between the periphery of said second radiating surface and said first radiating surface, and said support element is a cylindrical body, connected at one end to a centre of said driven speaker cone and at the other end to said second radiating surface, said connections allowing the efficient transfer of vibrational energy from said driven speaker cone to said second radiating surface.

2. The speaker as claimed in claim 1, wherein said first radiating surface is frustoconical for providing a nested configuration with said driven speaker cone.

3. The speaker as claimed in claim 1, wherein said driven speaker cone is driven by a voice coil connected to its rear face, and the diameter of said cylindrical supporting element is the same as the diameter of said voice coil.

* * * * *